US011811141B2

(12) United States Patent
West et al.

(10) Patent No.: US 11,811,141 B2
(45) Date of Patent: Nov. 7, 2023

(54) ACTIVE ELECTRONICALLY SCANNED ARRAY SYSTEM AND METHOD WITH OPTIMIZED SUBARRAYS

(71) Applicant: Rockwell Collins, Inc., Cedar Rapids, IA (US)

(72) Inventors: James B. West, Cedar Rapids, IA (US); Jeremiah D. Wolf, Atkins, IA (US); Michael L. Hageman, Mt. Vernon, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 90 days.

(21) Appl. No.: 17/583,863

(22) Filed: Jan. 25, 2022

(65) Prior Publication Data

US 2023/0307847 A1 Sep. 28, 2023

Related U.S. Application Data

(63) Continuation of application No. 16/103,742, filed on Aug. 14, 2018, now Pat. No. 11,271,321.

(51) Int. Cl.

| | |
|---|---|
| ***H01Q 21/00*** | (2006.01) |
| ***H01Q 5/55*** | (2015.01) |
| ***H01Q 3/36*** | (2006.01) |
| ***H01Q 21/22*** | (2006.01) |

(52) U.S. Cl.

CPC ..... *H01Q 21/0025* (2013.01); *H01Q 3/36* (2013.01); *H01Q 5/55* (2015.01); *H01Q 21/22* (2013.01)

(58) Field of Classification Search

CPC ..... H01Q 21/0025; H01Q 3/36; H01Q 5/55; H01Q 21/22

See application file for complete search history.

(56) References Cited

U.S. PATENT DOCUMENTS

| | | | |
|---|---|---|---|
| 9,735,469 | B1 | 8/2017 | West et al. |
| 10,158,180 | B1 | 12/2018 | Riley et al. |
| 10,541,476 | B1 | 1/2020 | West et al. |
| 10,714,840 | B1 | 7/2020 | West et al. |
| 10,811,787 | B1 | 10/2020 | West et al. |
| 11,133,604 | B1 | 9/2021 | West et al. |
| 2007/0001897 | A1 | 1/2007 | Alland |

(Continued)

OTHER PUBLICATIONS

00014300021, Jun. 9, 2014, West et al.

*Primary Examiner* — Dieu Hien T Duong

(74) *Attorney, Agent, or Firm* — Suiter Swantz pc llo

(57) ABSTRACT

Systems and methods provide an antenna array with separately fed subarrays. The systems and methods provide optimized or improved physical embodiments of each sub-banded subarray in terms of radiating element type and physical implementation, radio frequency integrated circuit (RFIC) technology choice, RFIC packaging and interconnect implementation, and/or intra-subarray feed typology choice and implementation. The antenna array can include first elements within a first distance range from a point in a surface associated with the antenna array and configured for first signals in a first frequency range, and second elements within a second distance range from the point and configured for second signals in a second frequency range. The antenna system also can include an interconnect system comprising a first multichip module and a second multichip module region.

6 Claims, 7 Drawing Sheets

(56) References Cited

U.S. PATENT DOCUMENTS

| | | | | |
|---|---|---|---|---|
| 2014/0203995 | A1* | 7/2014 | Romney | H01Q 21/065 343/893 |
| 2017/0054221 | A1 | 2/2017 | West et al. | |
| 2017/0338558 | A1 | 11/2017 | West | |
| 2018/0358686 | A1* | 12/2018 | Park | H01Q 21/08 |
| 2019/0013592 | A1 | 1/2019 | West et al. | |

* cited by examiner

ACTIVE ELECTRONICALLY SCANNED ARRAY SYSTEM AND METHOD WITH OPTIMIZED SUBARRAYS

CROSS-REFERENCE TO RELATED APPLICATIONS

The present application claims the benefit of U.S. patent application Ser. No. 16/103,742, filed on Aug. 14, 2018, titled "ACTIVE ELECTRONICALLY SCANNED ARRAY SYSTEM AND METHOD WITH OPTIMIZED SUBARRAYS", naming James B. West, Jeremiah D. Wolf, and Michael L. Hageman as inventors, which is incorporated herein by reference in the entirety.

BACKGROUND

Embodiments of inventive concepts disclosed herein relate generally to antenna systems including but not limited to antenna systems including arrays configured for particular wavelength ranges.

Modern sensing and communication systems may utilize various types of antennas to provide a variety of functions, such as communication, radar, and sensing functions. For example, ultra-high frequency (UHF) and very high frequency (VHF) radio systems use directional and omnidirectional antenna arrays for data and voice communication. In another example, radar systems use antenna arrays to perform functions including but not limited to: sensing, intelligence gathering (e.g., signals intelligence, or SIGINT), direction finding (DF), electronic countermeasure (ECM) or self-protection (ESP), electronic support (ES), electronic attack (EA) and the like. Operation across a large band (ultra-ultra wide band (UUWB)) while achieving lower size, weight, power, and cost (SWAP-C) is desirable.

SUMMARY

In one aspect, embodiments of the inventive concepts disclosed herein are directed to an antenna array. The antenna array includes a first group of first elements. The first elements are within a first range from a point in a surface associated with the antenna array. The antenna array also includes a second group of second elements. The second elements are within a second range from the point. The antenna array also includes a feed layer including a first region coupled to the first elements of the first group and a second region coupled to the second elements to the second group. The first region has a first top surface, and the second region has a second top surface. The first top surface is above the second top surface. The first elements have a first size corresponding to a first sub-band, and the first circuit board has a thickness corresponding to the first sub-band. The second elements have a second size corresponding to a second sub-band, and the second circuit board has a second thickness corresponding to the second sub-band. The first group and the second group are provided as part of wavelength scaled array arrangement In a further aspect, embodiments of the inventive concepts disclosed herein are directed to an antenna with separately fed subarrays. The antenna system includes a first subarray of first elements that are within a first distance range from a point on a surface associated with the antenna array and configured for first signals in a first frequency range. The antenna system also includes a second subarray of second elements which are within a second distance range from the point and configured for second signals in a second frequency range. The antenna system also includes an interconnect system comprising a first multichip module for an N by M array of the first elements and configured to convert the first signals in the first frequency range to first signals in an intermediate frequency range and a second multichip module region for an R by S array of the second elements configured to convert the second signals in the second frequency range to second signals in the intermediate frequency range. N, M, R and S are integers, and the first multichip module is coupled to the first elements via a first polarization synthesis network.

In a further aspect, embodiments of the inventive concepts disclosed herein are directed to a method of manufacturing an antenna array. The method includes providing at least one first circuit board including a first group of first elements, and providing at least one second circuit board comprising a second group of second elements. The first circuit board is thicker than the second circuit board. The method also includes joining the first circuit board and the second circuit board and providing at least one feed layer comprising a first region coupled to the first elements of the first group and a second region coupled to the second elements to the second group. The first group is farther from a center of the antenna array than the second group. The first region has a first top surface, and the second region has a second top surface. The first top surface is below the second top surface. The first circuit board has a thickness corresponding to the first sub-band, and the second circuit board has a thickness corresponding to the second sub-band. The first group and the second group are provided as part of wavelength scaled array arrangement, and the first thickness is thicker than the second thickness.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
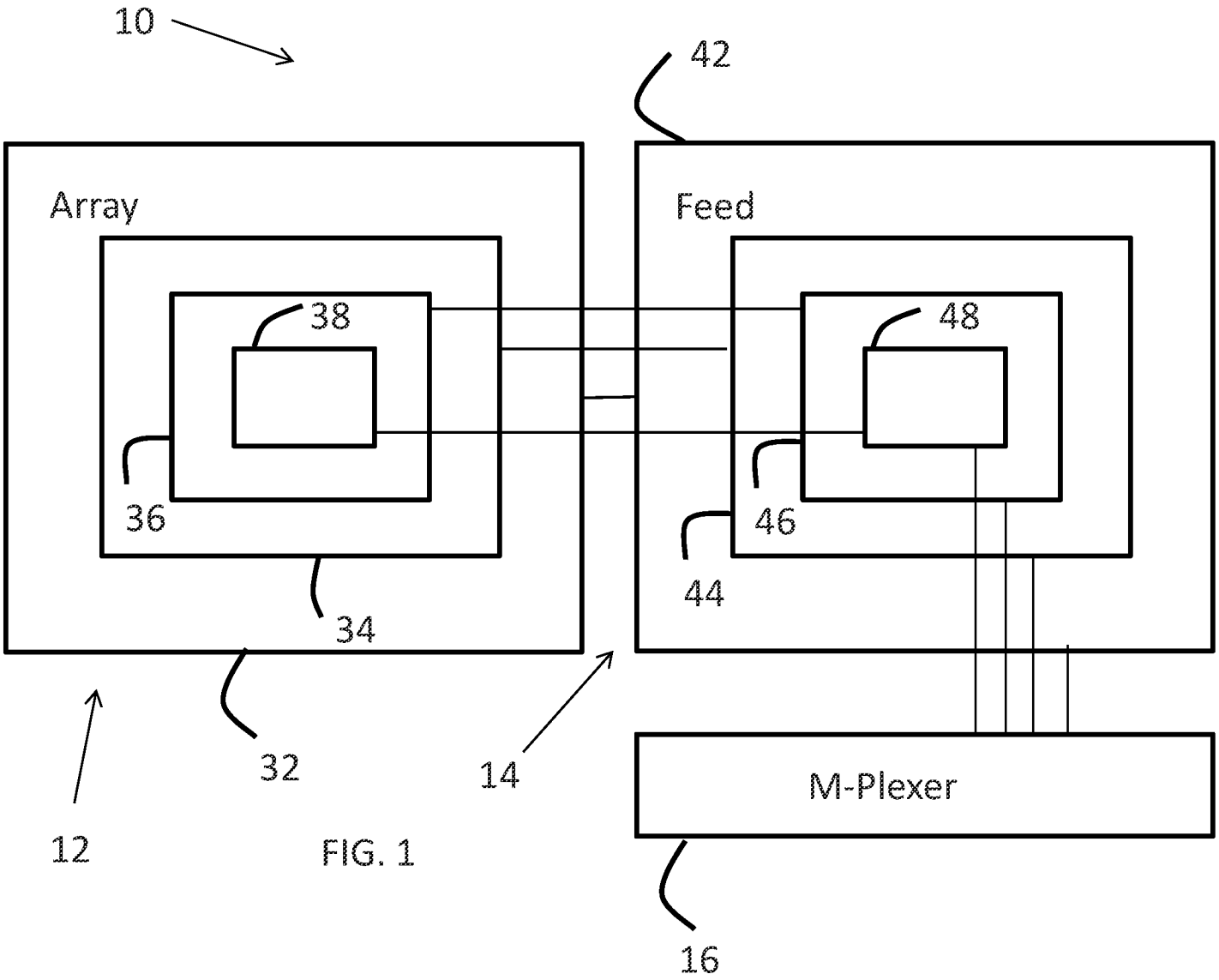
FIG. 1 is a general block diagram of an antenna system according to exemplary aspects of the inventive concepts disclosed herein.

Before describing in detail embodiments of the inventive concepts disclosed herein, it should be observed that the inventive concepts disclosed herein include, but are not limited to a novel structural combination of components and circuits disclosed herein, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

Some embodiments of the inventive concepts disclosed herein are directed to an aperture (e.g., a UUWB wavelength scaled array (WSA) active electronic scanning array (AESA) aperture) for use in the ultra high frequency (UHF) to W Band. In some embodiments, systems and methods directed to a low profile, UUWB antenna with 10:1 Instantaneous bandwidth (IBW). In some embodiments, tiling of circuit boards with antenna elements is used to integrate subarrays and corresponding feed arrays to provide a low SWAP-C antenna system. In some embodiments, the systems and methods scale the subarray aperture to arbitrarily large AESA apertures without grating lobes. In some embodiments, the systems and methods provide optimized physical embodiments of each sub-banded subarray in terms of radiating element type and physical implementation, radio frequency integrated circuit (RFIC) technology choice, RFIC packaging and interconnect implementation, and intra-subarray feed typology choice and implementation. In some embodiments, the AESA array is utilized in UUWB signal intelligence (SIGINT) receiver systems and/or other advanced radio and radar systems.

In some embodiments, the aperture is provided in a configuration (e.g., with subarrays with uninterrupted element lattice spacing) that can be more easily manufactured. In some embodiments, the aperture is provided in a configuration (e.g., with subarrays with uninterrupted element lattice spacing implementation) that can be provided using tiles including antenna element arrays individually configured for a respective sub-band that are joined together. In some embodiments, the aperture is provided in a planar and/or conformal WSA UUWB tightly coupled dipole array (TCDA) aperture topology. The manufacturing techniques and configurations described in "Wavelength Scaled Array Layout Optimization", U.S. patent application Ser. No. 15/825,711, and U.S. patent application Ser. No. 15/160,959 are used in some embodiments and are incorporated herein by reference in their entireties.

Referring to FIG. 1, an antenna system 10 for a communication, radar, or sensing system includes an antenna array 12, an antenna feed 14, and an optional M-plexer (where M is an integer). In some embodiments, the antenna system 10 is for a sensing radar system or electronic warfare radar system. In some embodiments, the antenna system 10 includes a 15-60 gigahertz array using miniature and high density RFIC packaging and interconnects appropriate for 60 gigahertz half wavelength spacing are used to prevent creating low formation at 60 gigahertz in some embodiments. In some embodiments, hardware embodiments are optimized or improved in a non-uniform fashion for subarrays of the antenna array 12.

The antenna array 12 includes an antenna element region 32 configured for a first frequency range, an antenna element region 34 configured for a second frequency range, an antenna element region 36 configured for a third frequency range, and an antenna element region 38 configured for a fourth frequency range. The first frequency range is lower than the second frequency range, which is lower than the third frequency range, which is lower than the fourth frequency range in some embodiments. The antenna element groupings are configured for the first frequency range, the second frequency range, the third frequency range, and the fourth frequency range based upon antenna element size and spacing in some embodiments. Each of the antenna element regions 32, 34, 36, and 38 corresponds to a sub-band or subarray and is provided on an individual circuit board or multi-board having a thickness corresponding to the subarray in some embodiments.

The use of subarray tiling techniques within the WSA aperture allows separate printed circuit boards to be used for each sub-band within the overall operational bandwidth of the WSA total bandwidth in some embodiments. Each of the antenna element regions 32, 34, 36, and 38 is provided on a separate circuit board in some embodiments. In some embodiments, one or more of the antenna element regions 32, 34, 36, and 38 are on multiple printed circuit boards or tiles. The antenna elements associated with the antenna element regions 32, 34, 36, and 38 (e.g., TCDA or the microstrip patch) have a thickness that is a function of both frequency and the dielectric constant of the circuit board. The use of separate circuit boards avoids design compromises associated with the antenna element regions 32, 34, 36, and 38 when building the antenna array 12 out of a monolithic printed circuit board, which is uniform in both dielectric constant and printed circuit board thickness due to fabrication limitations. In some embodiments, the circuit boards for the antenna element regions 32, 34, 36, and 38 have a thickness and dielectric constant (e.g., circuit board material) selected for the appropriate frequency band.

The antenna element regions 32, 34, 36 and 38 are rectangular-shaped regions for the disposition of antenna element groupings. The antenna element regions 32, 34, and 36 include holes within which the next regions of the antenna element regions 32, 34 and 36 are disposed. Other shapes of antenna element regions 32, 34, 36, and 38 can be utilized, including circular regions, pentagonal regions, hexagonal regions, square shaped regions, etc. The number of the antenna element regions 32, 34, 36, and 38 can vary according to design criteria and system parameters. The four antenna regions 32, 34, 36, and 38 are shown in FIG. 1 in an exemplary fashion.

The antenna feed 14 includes feed regions 42, 44, 46, and 48. The feed circuits or feed regions 42, 44, 46 and 48 provide connections as well as processing for the signals received and transmitted on the antenna array 12. The feed regions 42, 44, 46, and 48 are configured for operation in the first, second, and third frequency range, respectively, in some embodiments. The antenna element regions 32, 34, 36 and 38 are coupled respectively to the feed regions 42, 44, 46 and 48. The feed regions 42, 44, 46 and 48 are configured to operate in the first frequency range, the second frequency range, the third frequency range and the fourth frequency range, respectively. The feed regions 42, 44, 46 and 48 are coupled to the M-plexer 16, where M is an integer (e.g., 4). The number of the feed regions 42, 44, 46, and 48 can vary according to design criteria and system parameters and can correspond to the number of the antenna element regions 32, 34, 36, and 38.

The M-plexer 16 is a passive device that implements frequency domain multiplexing for the subarrays associated with the antenna element regions 32, 34, 36 and 38 in some embodiments. The M-plexer 16 receives and provides signals associated with the antenna element regions 32, 34, 36 and 38 via the feed regions 42, 44, 46 and 48. The M-plexer 16 is optional. In some embodiments, the antenna feed 14 is sub-banded as described, with a single UWB feed where each of the radio frequency (RF) input output (I/O) ports operates over the full UWB of the antenna array 12.

Figure 2:
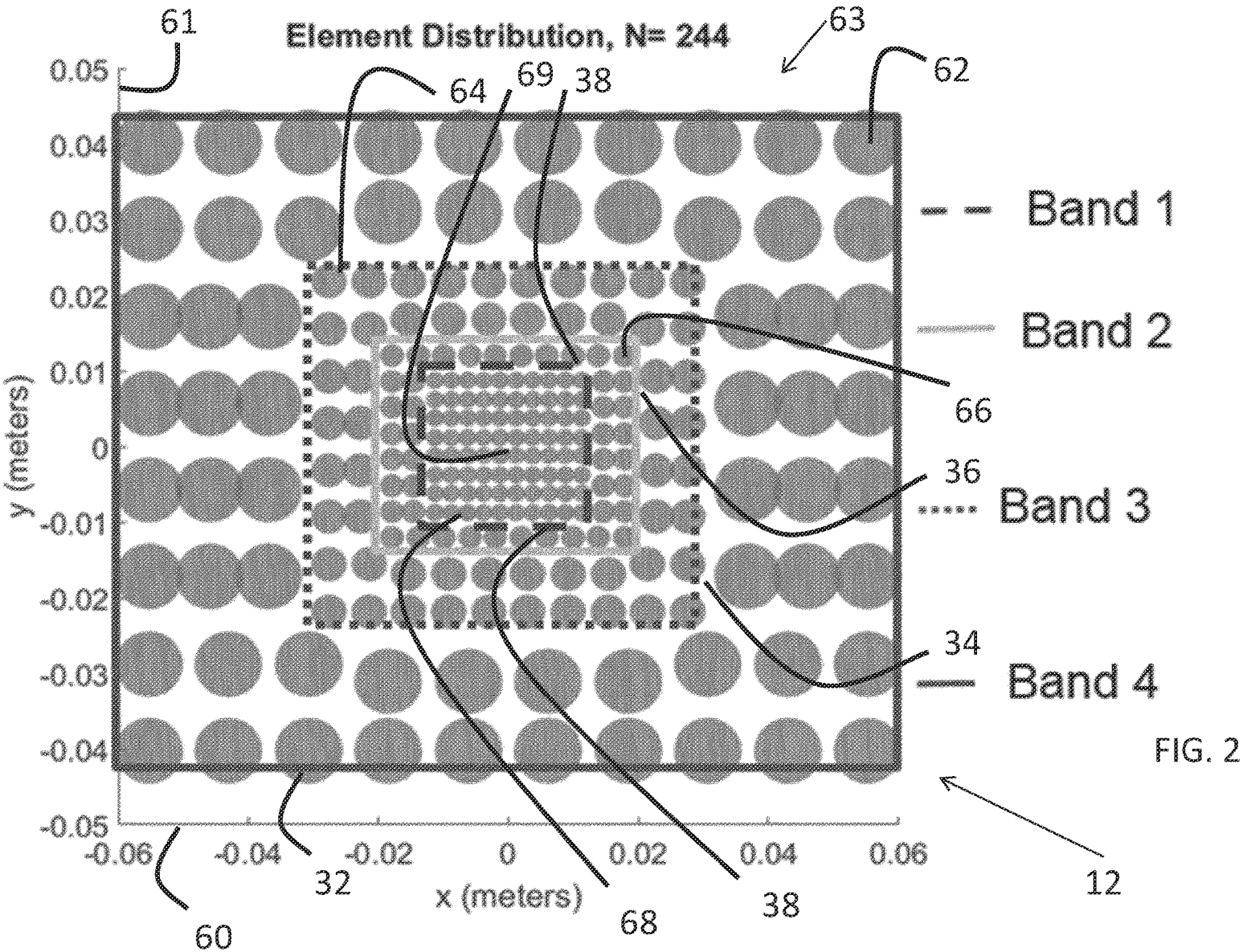
FIG. 2 is a top view schematic drawing of an antenna array of the antenna system illustrated in FIG. 1 according to exemplary aspects of the inventive concepts disclosed herein.

With reference to FIG. 2, the antenna array 12 is a UUWB WSA TCDA AESA aperture. The antenna array 12 is shown on a Cartesian plane including an X-axis 60 and a Y-axis 61. The X axis 60 extends from a negative meter position to a positive meter position, and the Y-axis 61 extends from a negative meter position to a positive meter position. Although particular sizes are shown for the antenna array 12 in FIG. 1, the sizes and dimensions are exemplary and other sizes and dimensions can be used depending upon system criteria and operational parameters. In some embodiments, the antenna array 12 has an X axis 60 that extends from a negative 0.4 meter position to a positive 0.4 meter position and a Y-axis 61 that extends from a negative 0.4 meter position to a positive 0.4 meter position. In some embodiments, the antenna array 12 has an X axis 60 that extends from a negative 0.9 meter position to a positive 0.9 meter position and a Y-axis 61 that extends from a negative 0.9 meter position to a positive 0.9 meter position.

The antenna array 12 includes sets of antenna elements 63 disposed about a center 69 on the surface of the antenna array 12. The sets of antenna elements 63 correspond to the antenna element regions 32, 34, 36, and 28. The antenna elements 63 are shown as circular printed circuit board structures in some embodiments, although other substrates, structures (e.g., metal elements), shapes and sizes can be utilized. In some embodiments, antenna elements 62 are provided in the antenna element region 32, antenna elements 64 are provided in the antenna element region 34, antenna elements 66 are provided in the antenna element region 36, and antenna elements 68 are provided in the antenna element region 38. The antenna element regions 32, 34, 36 and 38 are provided around the center 69. The antenna element region 38 is located closer to the center 69 than the antenna element region 36, which is located closer to the center 69 than the antenna element region 36, which is located closer to the center 69 than antenna element region 32. The sizes (e.g., areas) of the elements 63 increase with respect to the distance of the respective antenna element region 32, 34, 36 and 38 is to the center 69 in some embodiments.

In some embodiments, the elements 63 are arranged as a wavelength scaled array, which allows radio lattice density realization via a predefined lattice relaxation factor (LRF) described below. The LRF and the number of sub-band regions in the antenna array 12 can vary in accordance with system parameters and designed criteria. Each of the antenna element regions 32, 34, 36 and 38 is a subarray or a sub-region that can have a different aperture, feed manifold associated with antenna feed 14, different RF electronics (e.g. transmit receive module, radio frequency integrated circuits, beam formers, mixers, etc.), and different packaging and interconnect architecture topologies and physical embodiments. The antenna elements 63, the antenna feed 14, feed manifold RF signals, DC controls, and ground interconnects are designed for the individual antenna element regions 32, 34, 36 and 38 and sub-band transitions. Generally, the highest frequencies regions (e.g., the antenna element region 38) are the most complex and costly due to small aperture radiant element spacings and lattice density sizes relative to radio frequency integrated circuit packaging and integrated circuit dimensions.

As shown in FIG. 2, the distance between neighboring elements 62, 64, 66 and 68 decreases the closer the element is to the center 69 in some embodiments. The antenna elements 62, 64, 66 and 68 are smaller in area (e.g., effective area) the closer the element is to the center 69 in some embodiments. Such a configuration of spacing and element sizes provides for the dense pattern of the antenna elements 63 in some embodiments. The number of the elements 62, 64, 66 and 68 at the respective distances can be any number in some embodiments. The number of the elements 62, 64, 66 and 68 can be different from each other in some embodiments. The total number of elements (e.g., 244 in as shown in FIG. 2) varies according to system criteria and operational parameters.

The layout for the antenna elements 63 is provided as a wavelength scaled array (WSA) (e.g., a continuously scaled circular or rectangular WSA aperture) in some embodiments. The WSA arrangement reduces the number of the radiating elements 63 for the antenna array 12 over conventional layouts in some embodiments. The reduction in the number of the radiating elements 63 commensurately reduces the number of RFICs and associated electrical count, thereby reducing overall cost, overall DC power loads, and the challenges of thermal management. The layout can be optimized or improved with respect to size as the antenna elements 63 are provided more densely near the center 69 in some embodiments. In addition, the spacing between the antenna elements 63 associated with the layout can be changed to provide maximum density in some embodiments. A wavelength scale parameter can define the pattern for the antenna array 12 and is indicative of a wavelength scale factor (e.g., a lattice relaxation factor) indicating relaxation of antenna spacing (or relaxation of antenna spacing constraints) in some embodiments. In some embodiments, the antenna elements 63 near the center 69 are configured for higher frequency radio frequency signals and the antenna elements 63 farther from the center 69 are configured for lower frequency RF signals. In some embodiments, the antenna elements 69 in the centermost region of the antenna array 12 are configured to cover the entire operational bandwidth, the antenna elements 63 in the region next to the centermost region are configured to operate in a sub band below the highest portion and above the lowest portion of the operational bandwidth, and the antenna elements 63 at the periphery are configured to operate at the lower portion of the operational bandwidth. The wavelength scale parameter can indicate a density of the antennas of each band of the antenna system 10 as a function of position. For example, at least two adjacent antenna elements 63 of a first band can be spaced from one another by a first value of the wavelength scale factor, where the first value corresponds to the second frequency. Similarly, at least two adjacent antenna elements 63 of a second band can be spaced from one another by a second value of the wavelength scale parameter, where the second value corresponds to the third frequency. As illustrated in the various electronically scanned arrays described herein, including the antenna system 10, the spacing within bands can change in value from relatively inward bands to relatively outward bands. In some embodiments, the antenna elements 63 of each band have a half-wavelength spacing (e.g., the spacing amongst the antenna elements 63 of the first band is a half-wavelength, where the wavelength corresponds to the first frequency i.e. wavelength=c/first frequency, where c=speed of light).

The values of the wavelength scale parameter can correspond to the positions of the antenna elements 63 along with the frequency of the band. In a Cartesian coordinate system, the value of the wavelength scale parameter can be a function of frequency, element excitation, and/or element delay (or phase) for a particular antenna element 63 and can be a function of x, y, and frequency, where the antenna system 10 is configured as a planar array, and x- and y- refer to Cartesian coordinate dimensions. In a three-dimensional coordinate system, such as where the antenna system 10 is configured as a three-dimensional array—such as a conformal array configured to conform to a three-dimensional surface of an airborne platform or other platform—the value of the wavelength scale parameter can be a function of x, y, z, and frequency (or may be similarly determined in spherical or cylindrical coordinates as appropriate to the application). The wavelength scale parameter can be used to define a position of each antenna element 63 relative to a reference point, such as the center 69 of the antenna system 10, or a peripheral point. The wave length scaled parameter can be calculated and the corresponding pattern can be provided according to the principles of U.S. patent application Ser. No. 15/970,781, filed by West et al. on May 3, 2018, incorporated herein by reference in its entirety.

In some embodiments, the antenna array 12 has continual lattice spacing relaxation (antenna element 63 to antenna element 63 pitch or density relaxation) of the fundamental WSA aperture architecture. The array lattice spacing increases outwardly from the center 69 (the highest frequency region) of the array 12 to the perimeter of the array 12 (the lowest frequency region). This characteristic of the array 12 when configured as a WSA is used to advantage in terms of aperture printed circuit board implementation/realization, AESA feed manifold typology and implementation choices, RF integrated circuit (IC) technology choice and design, RFIC packaging and interconnect choice and design, and thermal management scheme (s) across the entire aperture. In some embodiments, technology disparate subarrays are electrically and almost seamlessly stitched together to optimally realize the hardware implementation of the antenna system 10. The antenna system 10 advantageously avoids some design compromises of conventional arrays which set the array lattice spacing for the highest frequency operation which drives the most complex physical implementation of all of the AESA's constitutive subassemblies, sub components, etc. in some embodiments. The antenna system 10 advantageously avoids some design compromises of conventional arrays which sets the absolute dimensional physical size of the array for lower operation frequency of the array, as based on the lowest frequency electrical parameters such as gain, beam width, etc. in some embodiments. The antenna system 10 avoids using the technologies and lattice spacings required for the highest frequency band across the entire array to reduce complexity, cost, fabrication and assembly yield issues, test challenges and reliability/environmental operational concerns in some embodiments.

In some embodiments, the antenna elements 63 are arranged in concentric circles or rectangular perimeters. Other elements and element patterns are appropriate for a non-symmetric or symmetric WSA. In some embodiments, the elements 63 are arranged as linear elements or multi-arm reactively load spirals. In some embodiments, the antenna elements 63 are linear dipoles or cross bowtie dipoles which are end chambered to fit around a given circumference. In some embodiments, the antenna elements 63 are configured for linear, elliptical and/or circular polarization.

An antenna element of appropriate size is used as each of the antenna elements 63 in some embodiments. The element 63 can be configured as an arched dual linear dipole (ADLD) radiating element as described in U.S. application Ser. No. 15/972,608 and U.S. application Ser. No. 14/832,908 or as linear dipole elements in some embodiments. Various polarization structures can be utilized for the antenna elements 63.

The antenna elements 63 are provided on printed circuit boards in some embodiments. The antenna elements 63 are printed circuit board trace conductors in some embodiments. The antenna elements 63 are provided using metal cutouts or other conductive structures in some embodiments. In some embodiments, the antenna elements 63 are provided on a single circuit board or on multiple circuit boards (e.g., tiles) that are joined together to form the antenna array 12.

Figure 3:
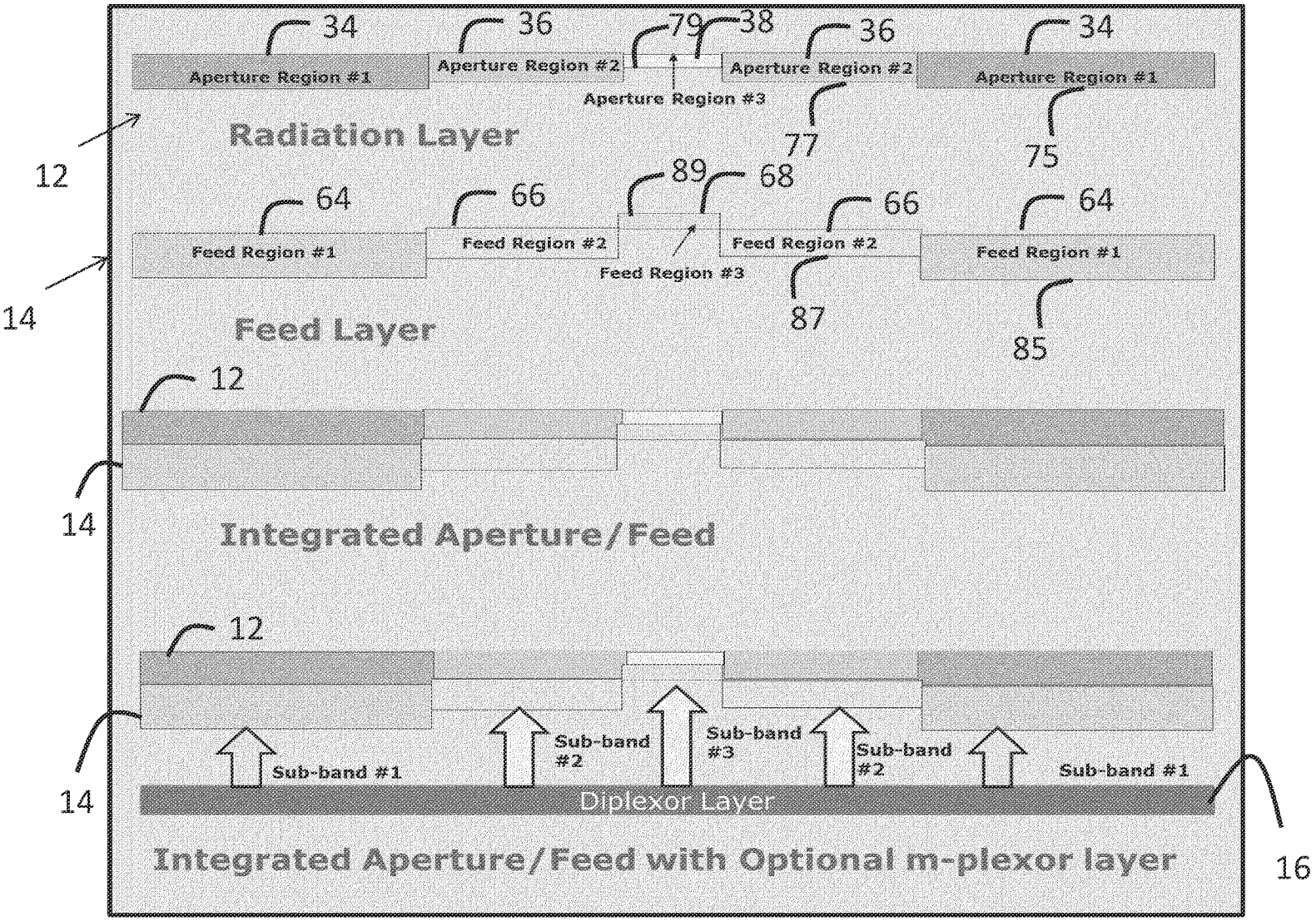
FIG. 3 is a cross sectional exploded view schematic drawing of a portion of the antenna system illustrated in FIG. 1 according to exemplary aspects of the inventive concepts disclosed herein.

With reference to FIG. 3, a portion of the antenna array 12 and the antenna feed 14 is shown. Only antenna element regions 34, 36 and 38 are shown in the antenna array 12 associated with the radiation layer or the antenna array 12, and only the feed regions 44, 46 and 48 associated with the antenna feed 14 are shown for simplicity in FIG. 3. The antenna element regions 34, 36 and 38 have coplanar top surfaces and have non-coplanar bottom surfaces, which correspond to non-coplanar top surfaces of the feed regions 44, 46 and 48 associated with the antenna feed 14. The antenna array 12 and the antenna feed 14 can be integrated together such that the bottom surfaces of the antenna element regions 34, 36 and 38 mate with the top surfaces of the regions 44, 46 and 48. The antenna element regions 34, 36 and 38 are provided on individual circuit boards 75, 77 and 79, respectively, and the feed regions 44, 46 and 48 are provided on individual circuit boards 85, 87 and 89, respectively. The circuit boards 75, 77 and 79 are circuit board panels joined according to U.S. patent application Ser. No. 15/825,711, U.S. Patent Publication No. 2017/0054221, and U.S. application Ser. No. 16/008,983 incorporated herein by reference. Similarly, the circuit boards 85, 87 and 89 are circuit board panels similarly formed. In some embodiments, the antenna array 12 is concave bending away from the antenna element region 38.

The typology for each the feed regions 44, 46, and 48 is individually selected for the appropriate sub-band and sub-band applications in some embodiments. The typologies includes but are not limited: constrained feed, corporate feed, semi-constrained feed, space feed, single and multi-beam, hybrid digital beamforming (superheterodyning down conversion with I/Q digital sapling at intermediate frequency) and direct RF-I/Q sampled digital beam forming. In some embodiments, the feed region 44 is associated with a single beam analog beam former, the feed region 46 is associated with a digital beam former and the feed region 48 is associated with a multi-beam analog beam former. Advantageously, the antenna system 10 employs different beam former architectures for different feed regions 44, 46 and 48 in some embodiments. The feed regions 44, 46 and 48 are reconfigurable to act either as coherent feeds across the operational bandwidth of the antenna system 10 or as sub-band feeds that are reconfigurable independently for each of the antenna element regions 34, 36 and 38 in some embodiments. The feed regions 44, 46, and 48 have heights configured for the respective sub-band in some embodiments. Advantageously, the lower and lowest frequency regions (regions 34 and 32) can operate with a hole in them for adequate performance in many scenarios while the higher frequency antenna feed regions 36 and 38 can operate within the hole.

Figure 4:
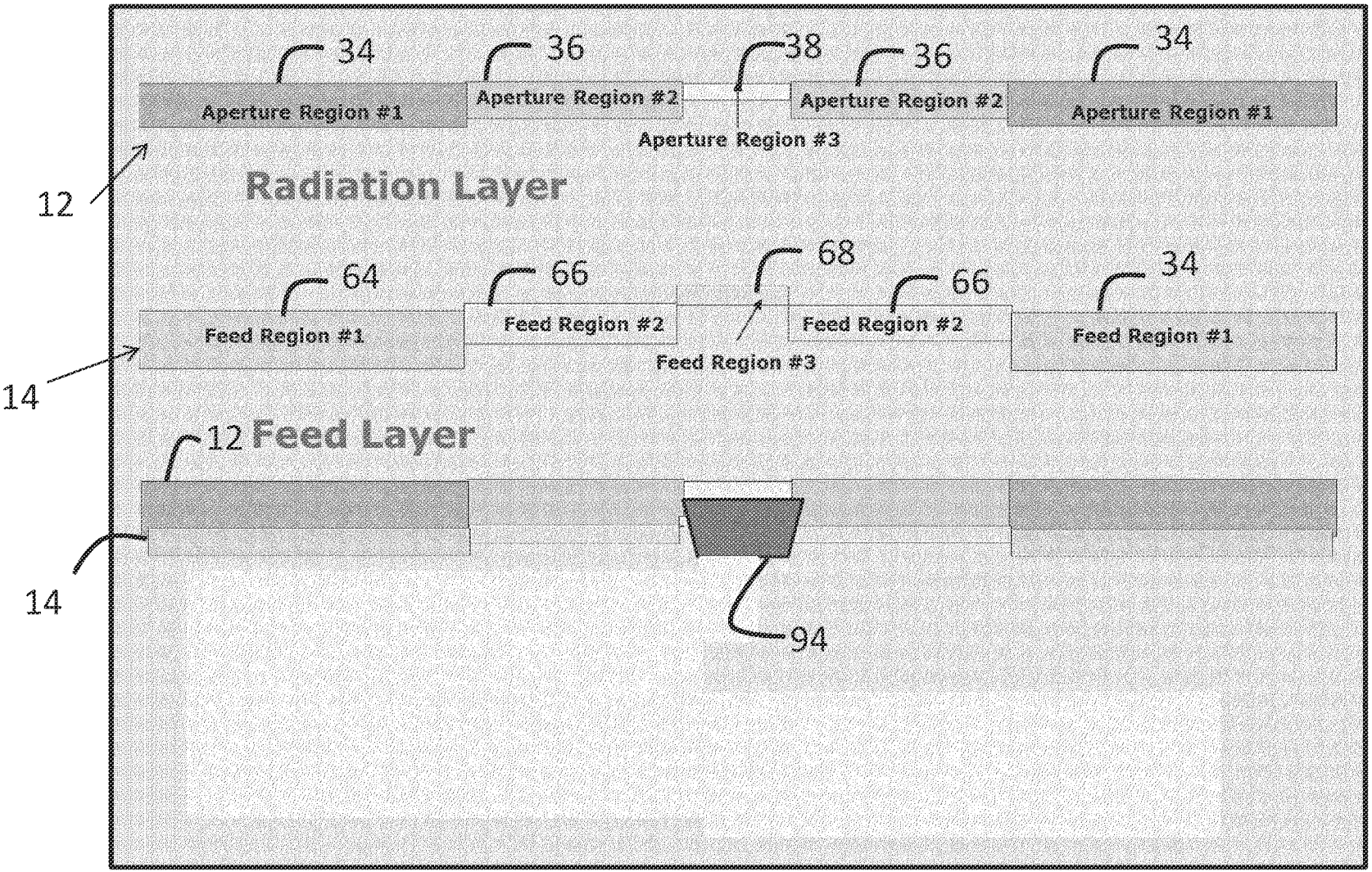
FIG. 4 is a cross sectional exploded view drawing a portion of the antenna system illustrated in FIG. 1 including a space feed according to exemplary aspects of the inventive concepts disclosed herein.

With reference to FIG. 4, the antenna array 12 includes a horn antenna 94 associated with the antenna element region 38 and the feed region 68. The horn antenna 94 is a space feed for a high frequency WSA center region (e.g. a millimeter wave operating region). Feed networks of the constrained transmission line feed topology can be utilized. In some embodiments, the horn antenna 94 is a semi-constrained horn feed.

Figure 5:
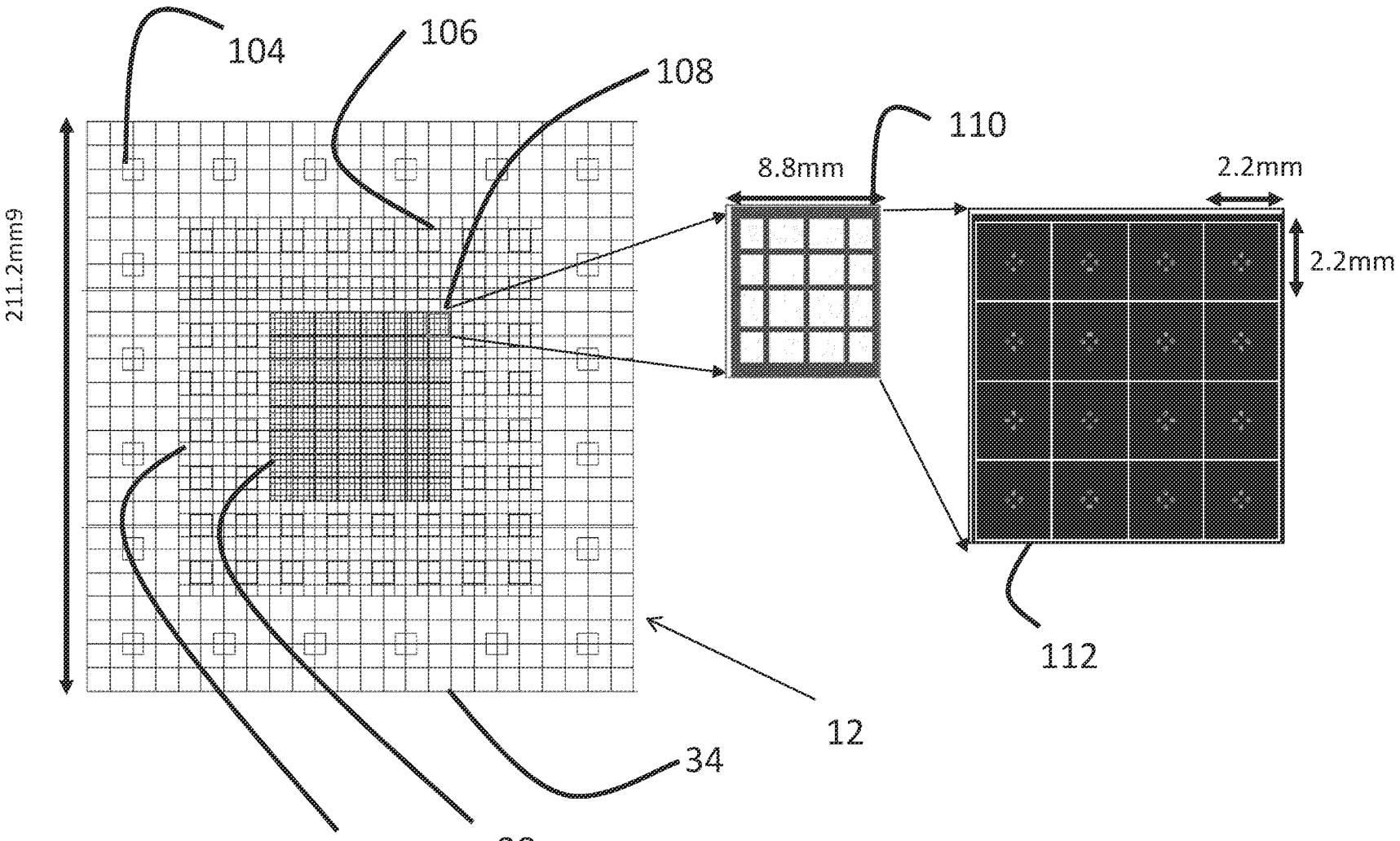
FIG. 5 is a bottom view schematic drawing of an interconnect architecture the antenna system illustrated in FIG. 1 according to exemplary aspects of the inventive concepts disclosed herein.

With reference to FIG. 5, an interconnect layout for the antenna element regions 34, 36 and 38 includes respective feed interconnects 104, 106, and 108. In antenna element region 38, a set 110 of antenna elements 112 correspond to the antenna elements 68 (FIG. 2). The antenna elements 112 are configured as dual linear polarized tightly coupled dipole array elements in some embodiments. Each feed interconnect 108 in the antenna element region 38 is coupled to sixteen antenna elements 112 (the set 110). The antenna elements 112 are 2.2 millimeters wide in some embodiments. Each feed interconnect 106 in the antenna element region 36 is coupled to sixteen antenna elements 66 (FIG. 2). Each feed interconnect 104 in the antenna element region 34 is coupled to sixteen antenna elements 64 (FIG. 2).

Figure 6:
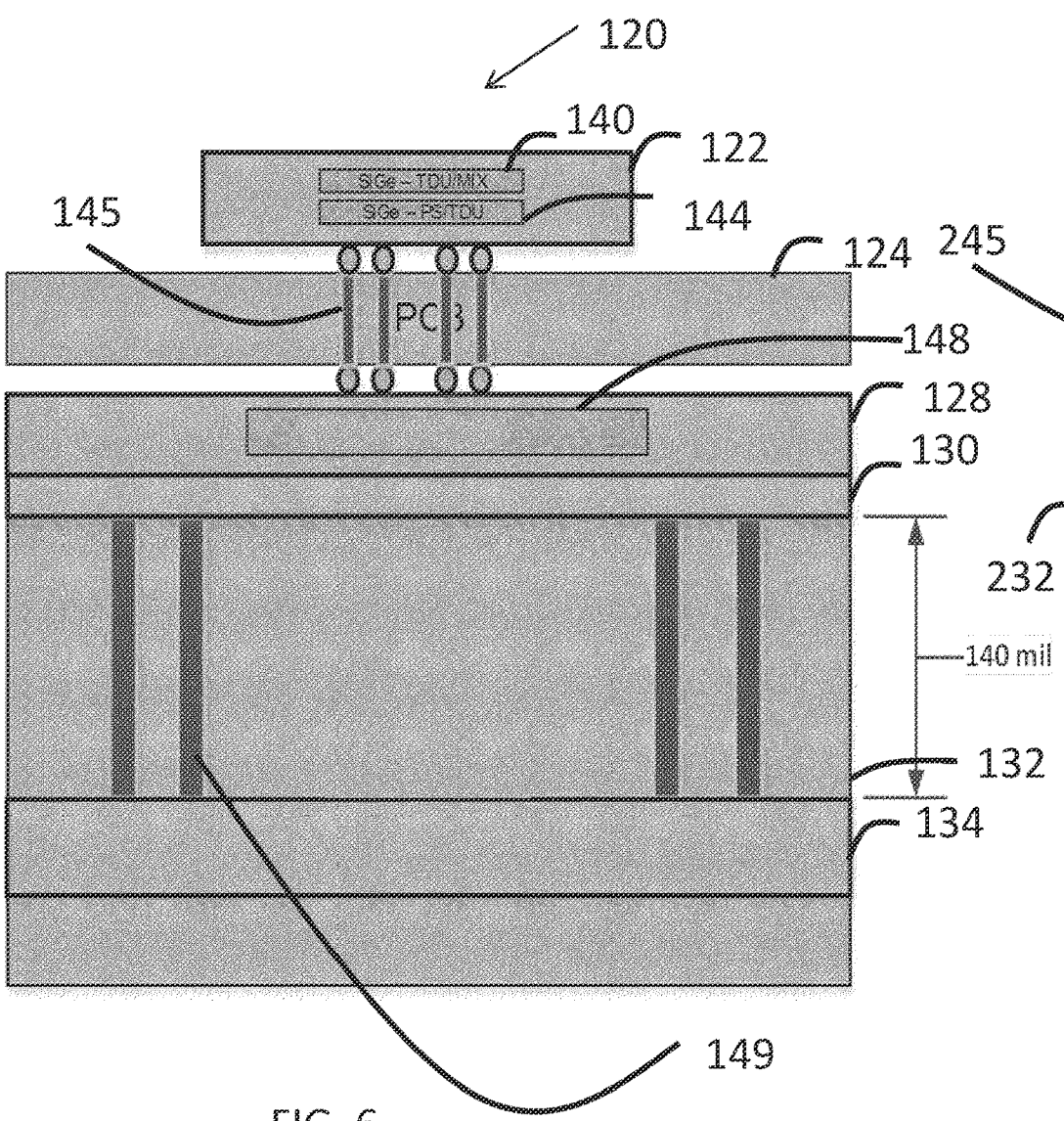
FIG. 6 is a side view schematic drawing of an interconnect package for a first band of the antenna system illustrated in FIG. 1 according to exemplary aspects of the inventive concepts disclosed herein.

With reference to FIG. 6, an interconnect structure 120 for operation in the 15 GHz band with the sixteen antenna elements 64 of the antenna element region 34 (FIG. 2) includes a multi-chip layer 122, a printed circuit board 124, an integrated circuit layer 128, a redistribution layer (RDL) 130, an interconnect layer 132 and antenna layer 134 associated with the circuit board 75. The multi-chip layer 122 includes an active integrated circuit 140 for time delay and mixing operations and an integrated circuit 144 for time delay and phase shifting operations. The multi-chip layer 122 is coupled to the printed circuit board 124 via integrated circuit connections and through vias 145 to an integrated circuit 148 in the integrated circuit layer 128. The RDL layer 130 is utilized provide connections to sixteen antenna elements 62 in a four by four arrangements in some embodiments. In some embodiments, the interconnect layer 132 is a TCDA structure, and the height of the interconnect layer 132 is 140 mils. The interconnect structure 120 is configured for analog or digital beam forming in some embodiments.

Figure 7:
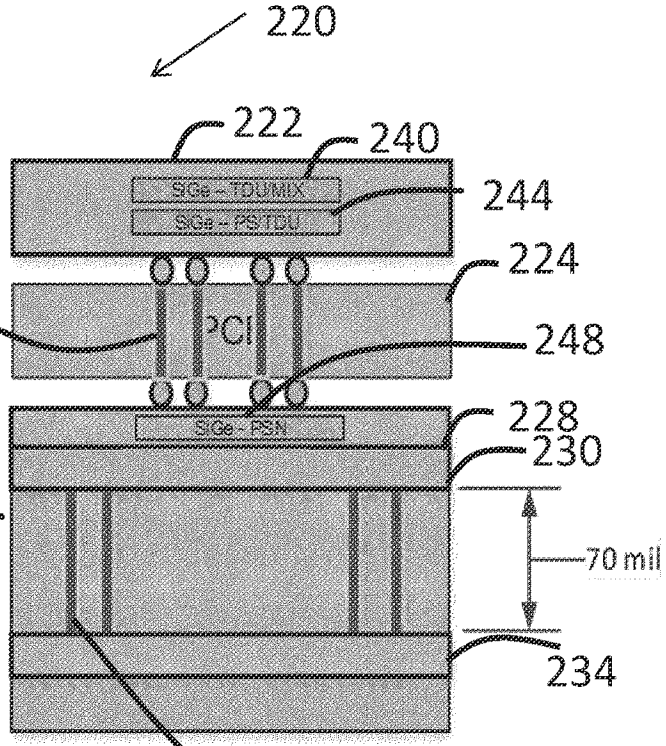
FIG. 7 is a side view schematic drawing of an interconnect package for a second band of the antenna system illustrated in FIG. 1 according to exemplary aspects of the inventive concepts disclosed herein.

With reference to FIG. 7, an interconnect structure 220 is utilized for connecting the antenna elements 68 associated with the antenna element region 38 in a 30 GHz band. The interconnect structure 220 includes a multi-chip layer 222, a PC board layer 224, an integrated circuit layer 228, an RDL 230, an interconnect layer 232 and an antenna layer 234 associated with the circuit board 77 (FIG. 2). The multi-chip layer 222 includes an active integrated circuit 240 for time delay and mixing operations and an integrated circuit 244 for time delay and phase shifting operations. The multi-chip layer 222 is coupled to a polarization synthesis network in an active integrated circuit 248 through vias 245 of the printed circuit board layer 224. The thickness of the layer 232 is 70 mils and includes vias 249 for connecting the RDL 230 to the antenna layer 234. In some embodiments, the interconnect layer 232 is a dipole feed portion of the TCDA structure. The interconnect structure 220 is configured for analog or digital beam forming in some embodiments.

Figure 8:
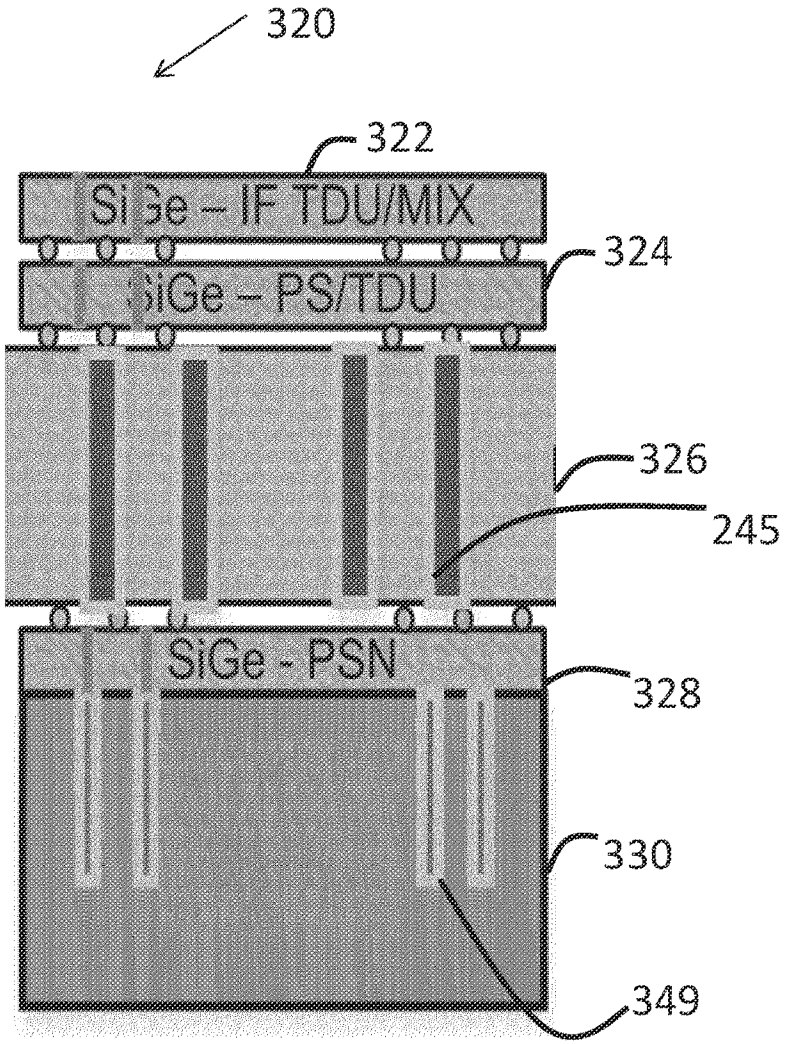
FIG. 8 is a side view schematic drawing of an interconnect package for a third band of the antenna system illustrated in FIG. 1 according to exemplary aspects of the inventive concepts disclosed herein.

With reference to FIG. 8, an interconnect structure 320 is associated with the set of antenna elements 68 (FIG. 2) or 110 (FIG. 5) for operation in the 60 GHz band. The interconnect structure 320 includes an integrated circuit 322 for intermediate frequency, time delay and mixer operations, an integrated circuit 324 for time delay and phase shifting and operations, an integrated circuit 328 for polarization synthesis network operations, an interconnect layer 326 and an antenna layer 330 having a thickness of 70 mil and including sixteen elements 68 or 110 (FIGS. 2 and 5). The elements 68 or 110 are arranged in a four by four TCDA relationship associated with the circuit board 39 (FIG. 3) in some embodiments. Vias 349 can provide connections to the antenna elements 68 or 110. Integrated thermal management, such as fluidic liquid cooling, hot/cold plates, heat pipes, etc. can be employed to reduce heat associated with the interconnect structures 120, 220, and 320. The interconnect structure 320 is configured for analog or digital beam forming and can serve as antenna in some embodiments.

In some embodiments, each interconnect structure 120, 220 and 320 is a multi-chip module associated with a separate M by N array where M and N are integers. Gapless tiling with numerous multichip modules of M by N arrays can be utilized for the center region of the antenna array 12. Transmit/receive circuits partitioned across multiple integrated circuit dies ease lattice density and RF integrated circuit footprints in some embodiments. The integrated circuit dies are mounted on both sides of the circuit boards 35, 37 or 39 or 134, 234, 330 for maximum area usage, to limit die stacking and improve RF performance. Through hole direct transition without routing or redistribution layers (RDLs) is used between radiating elements in radio frequency integrated circuits in some embodiments. The particular depictions provided in FIG. 6-8 are exemplary only. Other interconnect architectures and designs can be utilized.

In some embodiments, the antenna array 12 is manufactured by providing at least one circuit board 75 including the elements 64, providing at least one the circuit board 77 including the elements 66 and providing at least one circuit board 79 including the elements 68. The circuit board 75 is thicker than the circuit board 77 which is thicker than the circuit board 79. The circuit boards 75, 77, and 79 are joined and at least one antenna feed 14 including the feed regions 44, 46, and 48 are coupled to the elements 64, 66, and 68, respectively.

The antenna system 10 is constructed by providing at least one circuit board for the antenna element region 32 including the antenna elements 62. When multiple circuit boards are used, the techniques of U.S. Patent Publication No. 2017-0054221 can be used to join the boards for the antenna element region 32. At least one circuit board (e.g., the board 75) for the region 34 including the antenna elements 64 is similarly provided. The circuit board or multi-board for the region 42 and the circuit board or multi-board for the antenna element region 34 (e.g., board 75) are joined using the techniques of U.S. Patent Publication No. 2017-0054221 in some embodiments. The circuit board or multi-board for the antenna element region 32 is thicker than the circuit board or multi-board for the region 34. The circuit board for the regions 36 and 38 (e.g., boards 77 and 79) are similarly provided, have a similar thickness relationship and are joined to make the antenna array 12. The circuit boards for the regions feed 42, 44, 46, and 48 (e.g., boards 85, 87 and 89) are similarly provided and attached to each other using the techniques of U.S. Patent Publication No. 2017-0054221 in some embodiments. The circuit boards for the feed regions 42, 44, 46, and 48 have a similar thickness relationship (thinner toward the middle of the array 12) and are joined to the circuit boards for the regions 32, 34, 36, and 38. Respective electrical circuit board interconnections are made between the circuit boards for the regions 32, 34, 36, and 38 and the circuit boards for the feed regions 42, 44, 46, and 48. Respective bottom surfaces for the circuit boards for the regions 32, 34, 36, and 38 mate with the top surfaces for the circuit boards for the feed regions 42, 44, 46, and 48 in some embodiments. In some embodiments, the feed layer or antenna feed 14 is interconnected with the antenna array 12 using the interconnects 120, 220, and 320 discussed with reference to FIGS. 6-8.

It will be appreciated that the various ESAs described herein, including the antenna system 10, may include varying arrangements of antennas. In some embodiments, the subarrays of antennas are provided to form a three-dimensional array, which can be made conformal to a three-dimensional surface, such as a surface of an airborne platform.

The construction and arrangement of the systems and methods as shown in the various exemplary embodiments are illustrative only. Other numbers or types of antenna elements, other polarization configurations and other numbers or types dipole elements can be used. Although only a number of embodiments have been described in detail in this disclosure, many modifications are possible (e.g., variations in sizes, dimensions, structures, shapes and proportions of the various elements, values of parameters, orientations, etc.). For example, the position of elements may be reversed, flipped, or otherwise varied and the nature or number of discrete elements or positions may be altered or varied. Accordingly, all such modifications are included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

What is claimed is:

1. An antenna system with separately fed subarrays, the antenna system comprising:

a first subarray of a plurality of first elements, the first elements being within a first distance range from a point on a surface associated with the antenna system and configured for first signals in a first frequency range;

a second subarray of a plurality of second elements, the second elements being within a second distance range from the point and configured for second signals in a second frequency range; and an interconnect system comprising a first multichip module for an N by M array of the first elements and configured to convert the first signals in the first frequency range to a first signals in the first intermediate frequency range and a second multichip module for an R by S array of the second elements configured to convert the second signals in the second frequency range to second signals in the intermediate frequency range, wherein N, M, R and S are integers and wherein the first multichip module is coupled to the first elements via a first active polarization synthesis network.

2. The antenna system of claim 1, wherein the second multichip module is coupled to the second elements via a second active polarization synthesis network between the second multichip module and the second elements.

3. The antenna system of claim 2, wherein the first multichip module comprises a first phase shift network and the second multichip module comprises a second phase shift network.

4. The antenna system of claim 1, further comprising:

a third subarray of a plurality of third elements smaller than the first elements, the third elements being within a third distance range from the point and configured for third signals in a third frequency range, the third distance range being smaller than the first distance range, and the third frequency range being greater than the first frequency range, the first subarray of the first elements being disposed on a first circuit board, the first circuit board has a thickness corresponding to the first frequency range, the second subarray of the second elements being disposed on a second circuit board, wherein the second circuit board has a second thickness corresponding to the second frequency range, wherein the first subarray and the second subarray are provided as part of wavelength scaled array arrangement.

5. The antenna system of claim 1, further comprising:

a horn feed within a third distance range from the point and configured for third signals in a third frequency range, the third distance range being smaller than the first distance range.

6. The antenna system of claim 5, wherein the third frequency range is greater than the first frequency range.

* * * * *